US007740421B2

(12) United States Patent
Suilmann et al.

(10) Patent No.: US 7,740,421 B2
(45) Date of Patent: Jun. 22, 2010

(54) ARRANGEMENT FOR THE ADMISSION OF PRESSURIZED WATER TO SPRAY SYSTEMS

(75) Inventors: Franz-Heinrich Suilmann, Werne (DE); Michael Dettmers, Kamen (DE); Werner Reinelt, Bochum (DE); Sebastian M. Mundry, Lüdinghausen (DE)

(73) Assignee: DBT GmbH (DE)

( * ) Notice: Subject to any disclaimer, the term of this patent is extended or adjusted under 35 U.S.C. 154(b) by 327 days.

(21) Appl. No.: 11/565,916

(22) Filed: Dec. 1, 2006

(65) Prior Publication Data

US 2007/0158995 A1 Jul. 12, 2007

(30) Foreign Application Priority Data

Dec. 1, 2005 (DE) ..... 10 2005 057693

(51) Int. Cl.
*E21D 23/16* (2006.01)

(52) U.S. Cl. ..... 405/302; 299/81.2

(58) Field of Classification Search ..... 405/302; 239/101, DIG. 15; 299/12, 17, 34.05, 81.1, 299/81.2; 91/170 MP
See application file for complete search history.

(56) References Cited

U.S. PATENT DOCUMENTS 3,861,751 A * 1/1975 Erwien ..... 299/43
4,325,659 A * 4/1982 Plevak et al. ..... 405/299
4,358,160 A * 11/1982 Kissell et al. ..... 299/43
4,487,615 A * 12/1984 Taylor et al. ..... 95/154
4,737,052 A * 4/1988 Weirich et al. ..... 405/302

FOREIGN PATENT DOCUMENTS

DE 3301029 A1 * 7/1984
DE 38 02 992 C2 7/1994
DE 195 37 448 A1 5/1996
SU 1532718 A * 12/1989

* cited by examiner

*Primary Examiner*—Sunil Singh
(74) *Attorney, Agent, or Firm*—Baker & McKenzie LLP

(57) ABSTRACT

A water system for the admission of pressurized water to spray systems arranged on a powered support assembly for underground mining, having at least one spray system for plow or shearer track spraying and having at least one further spray system for goaf space spraying, canopy spraying and side spraying. A central water line feeds spray nozzles of the spray systems. To increase the operating reliability of the water system and thus of the powered support assembly, the control valves for the spray systems are accommodated in a spray valve block which is provided with a connection for the water line and which can be arranged on the powered support assembly as a unit separated from a hydraulic valve block.

8 Claims, 1 Drawing Sheet

ARRANGEMENT FOR THE ADMISSION OF PRESSURIZED WATER TO SPRAY SYSTEMS

Figure 1:
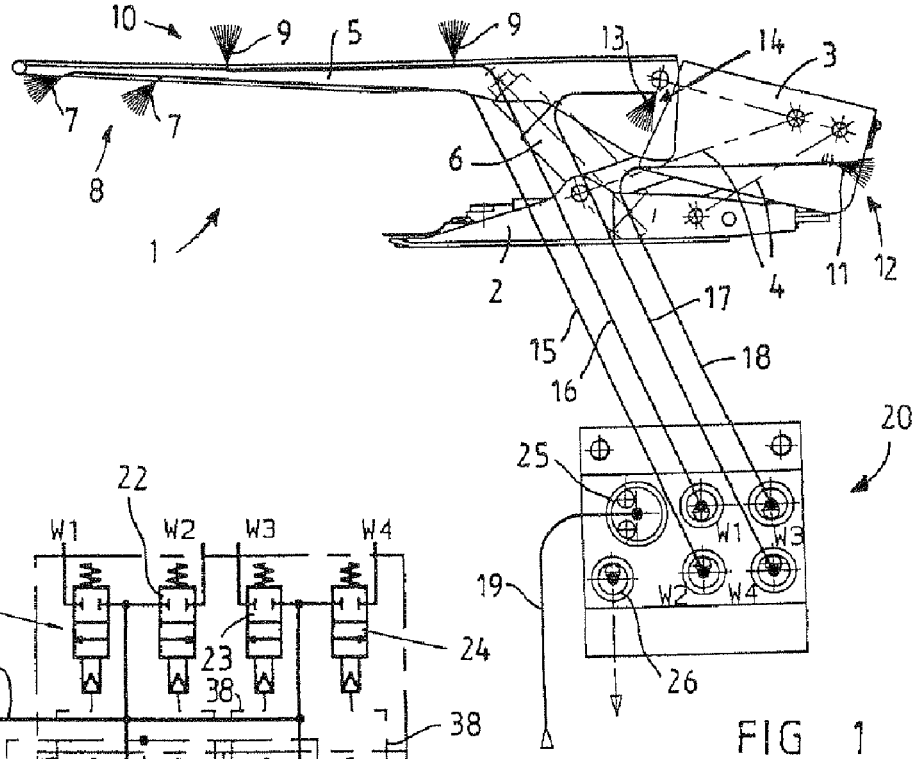

This application claims priority from German Patent Application No. 10 2005 057693.1, filed Dec. 1, 2005, which is incorporated herein by reference in its entirety.

The invention relates to an arrangement for the admission of pressurized water to spray systems arranged on powered support assemblies in underground mining, having at least one first spray system for plow or shearer track spraying and at least one further spray system for goaf space spraying, canopy spraying and/or side spraying, having a central water line for feeding spray nozzles of the spray systems, and having control valves arranged in a valve block for each spray system for switching the different spray systems on or off.

In the case of the powered support assemblies used in underground mining, it has been known for a long time to use spray nozzles for suppressing the fine coal dust detrimental to health and arising during the extraction of, for example, coal by means of a winning machine, such as in particular a plow or shearer loader, the working face being sprayed with spray water by said spray nozzles just before the winning machine travels past. For the plow or shearer track spraying, at least one spray nozzle for the associated track spray system is usually assigned to each shield, and a control valve is arranged in the hydraulic valve block of the powered support assembly for switching these nozzles on or off. The control valve is operated as a function of the position of the winning machine via the associated activating unit for the powered support assembly in order to initiate or stop the spray function.

It is known from DE 195 37 448 A1 of the generic type to also arrange spray systems for canopy moistening and goaf space moistening on a powered support assembly in addition to a spray system for the plow or shearer track spraying. Since, as a matter of priority, only the track spraying has to be supplied with water at high pressure, pressure-reducing valves are arranged between a central high-pressure water line and the control valves, at least for some of the spray systems, these pressure-reducing valves enabling the water pressure in the water line to be reduced from usually 150 to 200 bar to a low-pressure level of about 10 to 40 bar. The control valves are activated by pressure actuation with the same hydraulic medium as all the other control valves for the hydraulic consumers in the central hydraulic valve block. Used in this case for actuating the hydraulic consumers and for operating the control valves is a suitable emulsion, such as, for example, an HFA fluid, which is fed via a separate hydraulic line to all the powered support assemblies at the underground longwall.

Furthermore, it is known as prior art to couple the activation of the control valve for the spray system to certain operating functions of the support units. Thus, DE 38 02 992 C2 describes, for example, a spray valve device in which a spray nozzle is switched on automatically during the advancing movement of the powered support assembly.

The object of the invention is to increase the operating reliability of the arrangement for the admission of pressurized water to the spray systems on underground powered support assemblies.

This object is achieved according to the invention in that all the control valves for the spray systems are accommodated in a spray valve block which is provided with a connection for the water line and can be arranged or is arranged on the powered support assembly as a unit separated from a hydraulic valve block. In its basic idea, the solution according to the invention is based on complete separation of the fluid circuits of the spray water, on the one hand, and of the hydraulic medium harmful to the environment and detrimental to health, on the other hand. At the same time, the spray valve block provided according to the invention provides the precondition for being able to arrange a control valve that can be activated separately on the powered support assembly for each spray system without an increase in the construction space or the construction cost for the hydraulic valve block. According to the invention, the control valves for each spray system are arranged in an additional, separate spray valve block, and the spray valve block and the hydraulic valve block are spatially separated.

According to an especially preferred configuration, the control valves in the spray valve block are pressure-actuated and are activated by water pressure from the water line in a pressure-actuated manner. To this end, the spray water used for activating the control valves is preferably used only in the filtered state. The use of the spray water for activating the control valves firstly has the advantage that no connection at all for hydraulic medium needs to be provided in the spray valve block. The further advantage consists in the fact that the pressure of the spray water in the water line, at 150 bar, is in any case markedly lower than the pressure of the hydraulic medium, which is normally about 300 bar, so that overall both the control valves or activating valves in the valve block and the seals present there are subjected to lower loading.

According to a further advantageous configuration, the control valves are designed as 2/2-way directional valves which connect the water line to the respective spray system in the first control position and separate the associated spray system from the water line in the second control position. For the pressure-actuated activation of the control valves, an electrically, in particular electromagnetically, actuated activating valve is preferably assigned to each control valve in the spray valve block. Furthermore, four control valves and four activating valves can preferably be arranged in the spray valve block in order to be able to activate and control a total of four spray systems separately from one another. The activating valves can preferably be designed as 3/2-way directional valves which connect an activating line for the associated control valve to a leakage outlet in the spray valve block in the first control position and connect the water line to the activating line in a second control position for operating the control valve. Since the spray water is used for the pressure-actuated operation of the control valves, the spray water which is in the activating line when the control valves are closed can flow off via a leakage line without it being possible for environmentally hazardous contamination of the material in the longwall to occur.

Furthermore, the control valves are preferably accommodated in valve receptacles in the spray valve block which are oriented perpendicularly to the valve receptacles for the activating valves. In addition, if one of the spray systems is to be operated only with a lower water pressure, at least one pressure-reducing device can be arranged in the spray valve block. Furthermore, a filter device can also be arranged in the spray valve block in order to filter the spray water used for activating the control valves.

The invention also relates to a powered support assembly having floor skids, goaf shield, roof canopies and support props supporting the latter, fastened to which are the spray nozzles of the respective spray systems and a hydraulic valve block and a spray valve block provided according to the invention. The spray valve block is then preferably provided with individual functions or with all the functions described further above.

Figure 3:
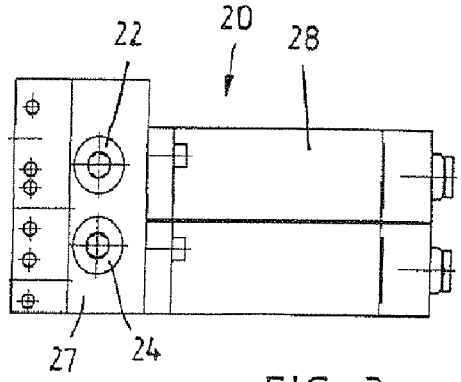
Figure 2:
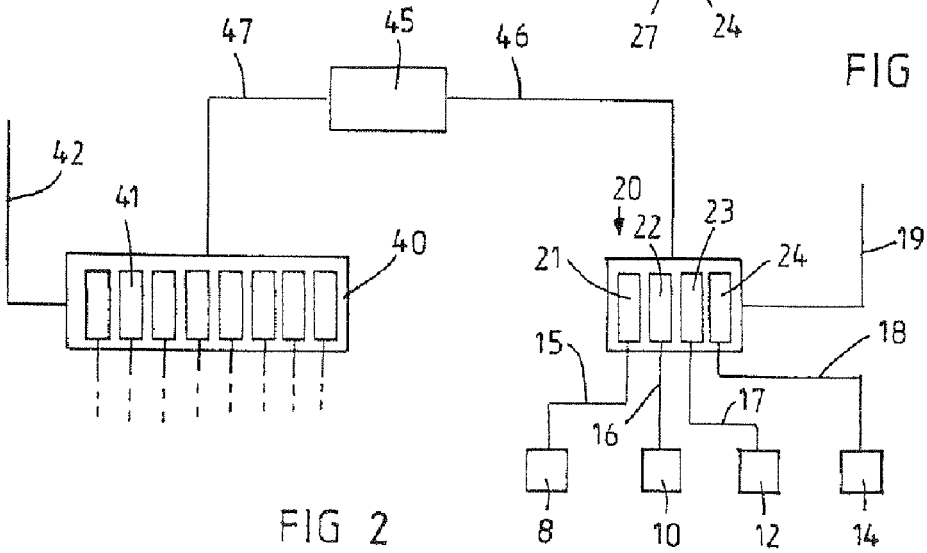

Further advantages and configurations of the invention follow from the description below of an exemplary embodiment shown schematically in the drawing, in which:

FIG. 1 schematically shows a powered support assembly in side view, having a spray valve block shown enlarged;

FIG. 2 shows, in a diagram, the separation of the hydraulic medium circuit and the water circuit;

FIG. 3 schematically shows the spray valve block in side view; and

Figure 4:
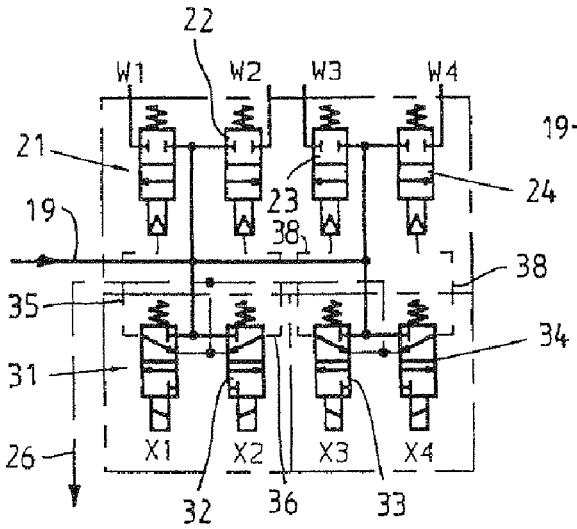

FIG. 4 shows the activation of the control valves in the spray valve block with reference to a simplified circuit diagram.

As is known to a person skilled in the art in underground mining, the powered support assembly 1 shown schematically in FIG. 1 and intended for keeping a longwall open in order to extract, for example, coal at a working face by means of a winning machine (not shown) such as a coal plow or a shearer loader has two floor skids 2, a goaf shield 3, schematically indicated lemniscate links 4, at least one roof canopy 5 and two hydraulically operable support props 6 for supporting the roof canopy 5. Arranged on the front end, facing the working face, of the roof canopy 5 are two spray nozzles 7 of a spray system 8 for the track spraying (plow or shearer track spraying) and two spray nozzles 9 for canopy spraying 10. A plurality of spray nozzles 11 for goaf space spraying 11 are arranged on the goaf shield 3, and furthermore additional spray nozzles 13 for gap or side spraying 14 are arranged on side cheeks. Each of the spray systems 8, 10, 12 and 14 is connected via separate supply lines 15, 16, 17, 18 to a separate consumer connection W1, W2, W3 and W4, respectively, in a spray valve block 20, a separate pressure-actuated control valve 21, 22, 23, 24 being assigned, as will be explained, to each of the consumer connections W1-W4. In addition, the valve block 20 has the water connection 25, shown schematically in FIG. 1, for a central water line 19, carrying the spray water at a high water pressure of, for example, 150 bar, and also a leakage opening 26.

The spray valve block 20 forms an independent unit which can be fitted and fastened to the powered support assembly 1 separately, preferably even spatially separately from a hydraulic valve block 40. To this end, FIG. 2, in a schematic diagram, shows both the spray valve block 20, accommodating the four control valves 21-24 and having the spray systems 8, 10, 12 and 14, respectively, connected via the respective feed lines 15-18, and the separate hydraulic valve block 40, here with a total of eight hydraulic control valves 41 for activating different hydraulic consumers such as, for example, the support prop on the powered support assembly, a canopy cylinder, a rear beam, etc. The schematic view in FIG. 2 illustrates that the spray valve block 20 is connected solely to the water line 19, while hydraulic fluid (e.g. HFA emulsion) is fed to the hydraulic valve block 40 via a hydraulic line 42. Only the electrical activation of the spray valve block 20 and the hydraulic valve block 40 is effected via a common electronic activating device 45, which is connected to the electric actuators of the control valves in the valve blocks 20 and 40 via the schematically indicated electrical activating lines 46 and 47, respectively.

The control valves 21-24 arranged in the spray valve block 20 are not electrically activated directly, but rather the activation is effected by pressure actuation via the four activating valves 31, 32, 33 and 34, respectively, shown in FIG. 4, of which each is assigned to one of the control valves 21, 22, 23, 24. To this end, the spray valve block 20 is of multipart design having a first accommodating block 27 for the control valves 21-24 and a second housing block 28 for the activating valves 31-34 and their electrically operable actuators, such as, in particular, electromagnets. In this case, as shown in particular in FIG. 3, the receptacles for the control valves 22, 24 and the receptacles for the activating valves are oriented perpendicularly to one another.

Furthermore, it can readily be seen from the diagram in FIG. 4 that the control valves 21-24 are each designed as 2/2-way directional valves having spring-return valve spools. In the control position shown in FIG. 4, the control valves 21-24 separate the spray water line 19 from the consumer connections W1-W4; on the other hand, when the control state of the control valves changes, the consumer connections W1-W4 are connected to the water line 19 for switching on the spray system. The pressure-actuated control valves 21-24 are activated with the spray water and water pressure from the water line 19, for which purpose the activating valve 31 is in each case connected upstream of the valve spool of the respective control valve 21-24 via an activating line 35, 36, 37 or 38 depicted by a broken line. The activating valves 31-34 are each 3/2-way directional valves which allow the water line 19 and thus the spray water present in the latter, although filtered beforehand, to flow into the activating line 35-38 for the associated control valve 21-24 only when the electric actuator or electromagnet of the respective activating valve 31-34 is operated, as a result of which the valve spool of this activating valve 31-34 is displaced from the control position shown, in which the activating line 35 is connected to a leakage connection, into the other control position, in which the water line 19 is connected to the respective activating line 35-38. As soon as the activating valve 31-34 returns into its initial position, the water in the respective activating line 35-38 can flow off to the leakage connection 26, and the control valve 21-24 returns into its closed position due to the return force of a spring.

From the preceding description, the person skilled in the art can deduce numerous modifications which ought to come within the range of protection of the attached claims. It goes without saying that the spray valve block may also be given further control valves for additional spray functions at the powered support assembly. The spray valve block and the hydraulic valve block are preferably fastened to the powered support assembly spatially separately from one another. However, for the separation of the two fluid circuits, it is also sufficient to flange-mount the spray valve block, designed as a separate unit, for example laterally on the hydraulic valve block, since even then there is no risk of fluid being able to pass from the one circuit into the other circuit.

The invention claimed is:

1. A water system for the admission of pressurized water to spray systems arranged on a powered support assembly for underground mining, comprising:

at least one plow or shearer track spray system including at least one spray nozzle;

at least one of a goaf space spray system including at least one spray nozzle, a canopy spray system including at least one spray nozzle, and a side spray system including at least one spray nozzle;

a central water line for feeding the at least one plow or shearer track spray system spray nozzle and the at least one of the at least one goaf space spray system spray nozzle, the at least one canopy spray system spray nozzle, and the at least one side spray system spray nozzle;

a spray valve block;

a central water line connection located on the spray valve block; and a plurality of control valves, each of the plurality of control valves being arranged in the spray valve block, wherein each of the plurality of control valves is associated with a respective one of the plow or shearer track spray system and the at least one of the goaf space spray system, the canopy spray system, and the side spray system; and the spray valve block is located on the powered support assembly as a unit separated from a hydraulic valve block, wherein fluid circuits of the spray valve block are connected solely to the central water line such that the spray valve block is completely separated from a hydraulic medium.

2. The water system of claim 1, wherein each of the plurality of control valves is pressure-actuated and activated by water pressure of the central water line.

3. The water system of claim 1, wherein each of the plurality of control valves includes a 2/2-way directional valve connecting the central water line to the respective spray system in a first control position and separating the central water line from the respective spray system in a second control position.

4. The water system of claim 1, further comprising a plurality of electrically-operable activating valves each located in the spray valve block, wherein each of the plurality of activating valves is associated with a respective one of the plurality of control valves.

5. The water system of claim 4, wherein the plurality of control valves includes four control valves located in the spray valve block; and the plurality of activating valves includes four activating valves located in the spray valve block.

6. The water system of claim 4, further comprising:

a plurality of activating lines, each of the plurality of activating lines being associated with a respective one of the plurality of control valves; and a leakage outlet located in the spray valve block, wherein each of the plurality of activating valves includes a 3/2-way directional valve connecting a respective one of the plurality of activating lines to the leakage outlet in a first control position and connecting the respective one of the plurality of activating lines to the central water line in a second control position.

7. The water system of claim 4, further comprising:

a plurality of control valve receptacles located in the spray valve block; and a plurality of activating valve receptacles located in the spray valve block, wherein each of the plurality of control valves is located in a respective one of the plurality of control valve receptacles; each of the plurality of activating valves is located in a respective one of the plurality of activating valve receptacles; and the plurality of control valve receptacles is oriented perpendicularly to the plurality of activating valve receptacles.

8. The water system of claim 1, further comprising at least one pressure-reducing device for spray water, at least one filter device for the spray water, or a combination thereof located in the spray valve block.

* * * * *